United States Patent [19]

Yamamoto

[11] Patent Number: 4,737,602

[45] Date of Patent: Apr. 12, 1988

[54] SLIDABLE CONTACT SWITCH FOR CARD MODULE

[75] Inventor: Hiromi Yamamoto, Oume, Japan

[73] Assignee: Kabushiki Kaisha Toshiba, Kawasaki, Japan

[21] Appl. No.: 19,784

[22] Filed: Feb. 27, 1987

[30] Foreign Application Priority Data

Mar. 3, 1986 [JP] Japan ..... 61-29240[U]

[51] Int. Cl.[4] ..... H01H 1/52; H01H 1/02; H01H 1/36

[52] U.S. Cl. ..... 200/16 D; 200/16 C; 200/291; 200/292; 200/275; 200/252

[58] Field of Search ..... 200/291, 292, 16 R, 200/16 A, 16 C, 16 D, 252, 257, 275

[56] References Cited

U.S. PATENT DOCUMENTS

| | | | |
|---|---|---|---|
| 2,762,880 | 9/1956 | Hathorn et al. | 200/291 X |
| 2,966,560 | 12/1960 | Gluck | 200/16 C |
| 3,072,757 | 1/1963 | Gluck | 200/16 D |
| 3,226,515 | 12/1965 | Concelman | 200/291 X |
| 3,940,585 | 2/1976 | Schaad | 200/159 R |
| 3,996,432 | 12/1976 | Sikora | 200/291 X |
| 4,168,404 | 9/1979 | Lockard | 200/16 D |
| 4,268,728 | 5/1981 | Rose | 200/16 R |
| 4,316,067 | 2/1982 | Whiteman, Jr. | 200/291 |

FOREIGN PATENT DOCUMENTS

| | | | |
|---|---|---|---|
| 1224568 | 6/1960 | France | 200/16 D |
| 555963 | 2/1957 | Italy | 200/291 |
| 217142 | 1/1942 | Switzerland | 200/291 |

*Primary Examiner*—Henry J. Recla
*Assistant Examiner*—Ernest G. Cusick
*Attorney, Agent, or Firm*—Cushman, Darby & Cushman

[57] ABSTRACT

To obtain a simple slidable switch structure of click operation type for changing over conductive patterns on a printed circuit board fixed in a card housing of a card module, the switch comprises three fixed through hole contacts formed in the board, and a movable contact formed with two convex contact portions. The movable contact is preferably coated with an insulating material except for the two convex portions and is directly disposed within the housing. When the movable contact is moved to and fro, the movable contact member deformably assembled within the insulation member is selectively and slidably brought into contact with two of the three fixed through hole contacts for changing-over operation.

3 Claims, 2 Drawing Sheets

SLIDABLE CONTACT SWITCH FOR CARD MODULE

BACKGROUND OF THE INVENTION

1. Field of the Invention

The present invention relates generally to a slidable switch for a card module and more specifically to a switch structure of slidable click operation type provided on a printed circuit board housed within a thin card module housing.

2. Description of the Prior Art

Recently, card modules such as memory cards or IC cards are often utilized for a computer system. In a memory card A as shown in FIG. 1, a printed circuit board on which semiconductor chips are mounted is housed within a thin card module housing. The printed circuit board is connected to a terminal equipment (not shown) of the system when the card module is inserted into a slot formed in the terminal equipment. In this case, plural female connector contacts B are engaged with plural male connector contacts arranged in the terminal equipment for connection between the card module and the terminal equipment. When a read/write memory chip is mounted on the printed circuit board, for instance, a write protect switch C as shown in FIG. 1 is required to timely inhibit data from being written in the chip. However, since the thickness of the card is as thin as about 2 mm, for instance, the switch structure is severely restricted from the standpoints of design, manufacturing, precision, click feeling, cost, etc.

An example of prior-art change-over switches for a printed circuit board (referred to as PCB hereinafter) housed in a card module is shown in FIG. 2. In the drawing, three fixed contacts 2*a*, 2*b* and 2*c*, for instance are arranged on a PCB 1 in regular spaced positional relationship to each other; a movable metal contact 3 selectively contactable with at least two of these three fixed contacts 2*a*, 2*b* and 2*c* is supported by an insulation member 4; and this insulation member 4 is slidably housed in a card module housing 5. In the switch structure of a card module as described above, in order to allow the movable metal contact 3 to be selectively brought into contact with the two fixed contacts 2*a* and 2*b* or the two fixed contacts 2*b* and 2*c* (as shown in FIG. 2), two convex portions 4a are formed in the outer surface of the insulation member 4 and three concave portions 5*a* are formed in the inner surface of the card module housing 5 for providing slidable click operation. That is to say, the switch ON-or-OFF position is sensed by the operator in dependence upon the click sound or the click feeling. In the prior-art switch structure of a card module, however, there exist some problems in that the insulating member 4 and the card module housing 5 are complicated in shape, small in the degree of design freedom, and additionally require long assembly time in adjusting the mutual fitting positional relation between the two members 4 and 5.

SUMMARY OF THE INVENTION

With these problems in mind, therefore, it is the primary object of the present invention to provide a slidable switch for a card module of slidable click operation type provided on a printed circuit board housed within a thin card module housing, in spite of a relatively simple structure.

To achieve the above-mentioned object, the slidable switch for a card module provided on a printed circuit board housed within a card module housing formed with an opening, according to the present invention, comprises: (a) at least three fixed recessed contact arranged in the board; and (b) a movable contact formed with at least two convex contact portions selectively contactable to at least two of said fixed recessed contacts when moved to and fro within the card module housing and with a knob portion having a size and shape so as to extend outwardly through the opening in the card module housing, at least the knob portion being coated with a insulating material, whereby movement of the knob within the opening controls the selective contact of the convex contact portions with the fixed recessed contacts.

When the insulation means is moved to and fro by the use of the knob, the movable contact means elastically assembled within the insulation means is selectively and slidably brought into contact with the fixed recessed contact means for click change-over operation.

BRIEF DESCRIPTION OF THE DRAWINGS

The features and advantages of the slidable switch for a card module provided on a printed circuit board haused within a thin card module housing according to the present invention will be more clearly appreciated from the following description taken in conjunction with the accompanying drawings in which like reference numeral designate corresponding elements and in which.

DETAILED DESCRIPTION OF THE PREFERRED EMBODIMENT

Figure 1:
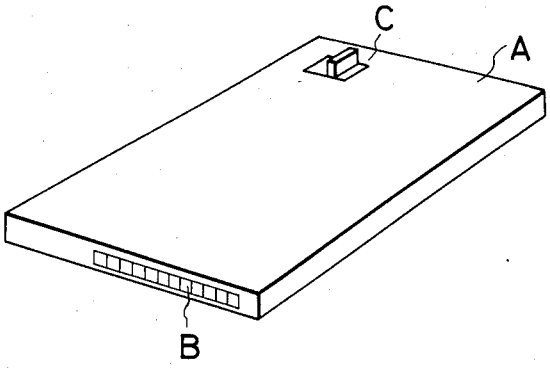
FIG. 1 (PRIOR ART)
FIG. 1 is a perspective view showing a Prior Art card module provided with a switch and plural female connector contacts.
Figure 2:
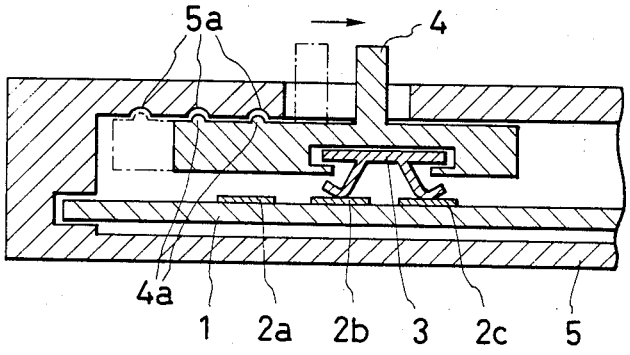
FIG. 2 (PRIOR ART)
FIG. 2 is a cross-sectional view showing an example of prior-art switches of the card module.
Figure 3:
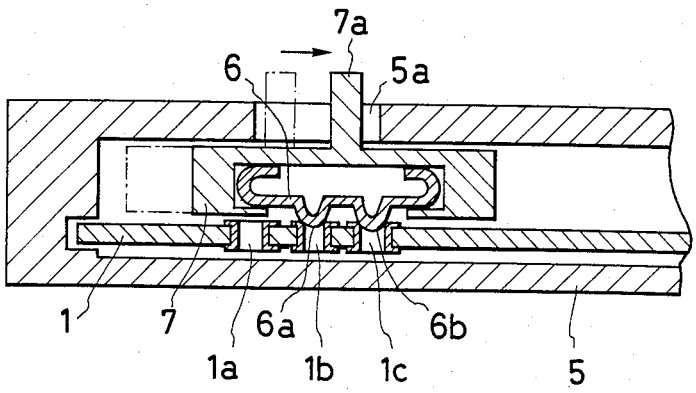
FIG. 3 is a cross-sectional view showing a first embodiment of the slidable switch for a card module according to the present invention.

An embodiment of the slidable switch for a card module according to the present invention will be described hereinbelow with reference to FIG. 3.

In the drawing, a printed circuit board (PCB) 1 is formed with three fixed through hole contacts 1*a*, 1*b* and 1*c* covered by a conductive material being arranged at regular intervals in a straight line. The conductive material of each of these through hole contacts 1*a*, 1*b* and 1*c* is connected to a conductive pattern printed on the PCB. A movable contact member 6 made of an elastic metal and formed with two conical convex contact portions 6*a* and 6*b* is slidably disposed on the PCB 1 so as to be selectively engageable with the two fixed through hole contacts 1*a* and 1*b* or the two fixed through hole contacts 1*b* and 1*c* (as shown in FIG. 3). Both the side ends of the movable contact member 6 are bent into a U-shape in cross-section, respectively, so that the movable contact member 6 is elastically and deformably assembled into an inner space of a box-shaped insulation member 7 and the two convex contact portions 6*a* and 6*b* are brought into pressure contact with the fixed through hole contacts 1*a* and 1*b* or 1*b* and 1*c*. In addition, this insulation member 7 is also slidably assembled in an inner space of a housing 5 for accommodating the PCB 1, and a knob 7*a* is formed integral with the insulation member 7 in such a way as to project through an opening 5*a* formed in the card module housing 5.

The operation of the above embodiment will now be described. To change-over the switch, the operator moves the insulation member 7 from a first position shown by the dashed lines in FIG. 3 to a second position as shown in FIG. 3 or vice versa by pushing the knob 7*a* in either direction. That is, at the position shown by the dashed lines in FIG. 3, since the convex contact portions 6*a* and 6*b* of the movable contact member 6 are fitted and brought into pressure contact with the fixed through hole contacts 1*a* and 1*b*, both the through hole contacts 1*a* and 1*b* are connected to each other. At the position shown in FIG. 3, both the fixed through hole contacts 1*b* and 1*c* are connected to each other.

In the embodiment of the present invention, the insulation member 7 and the housing 5 are both simple in shape and structure, because no convex or concave portions are required to be formed in the housing 5, and thereby the degree of freedom can be increased in design and the manufacturing work is easy. Therefore, these two parts 5 and 7 can be formed into a small shape at low cost in accordance with molding process. In addition, the assembling work can be facilitated because the stable operation of the switch for a card module can be secured by checking only the dimensional and positional relationship between the convex portions 6*a* and 6*b* of the movable contact member 6 and the fixed through hole contacts 1*a*, 1*b* and 1*c* formed in the PCB 1.

Figure 4:
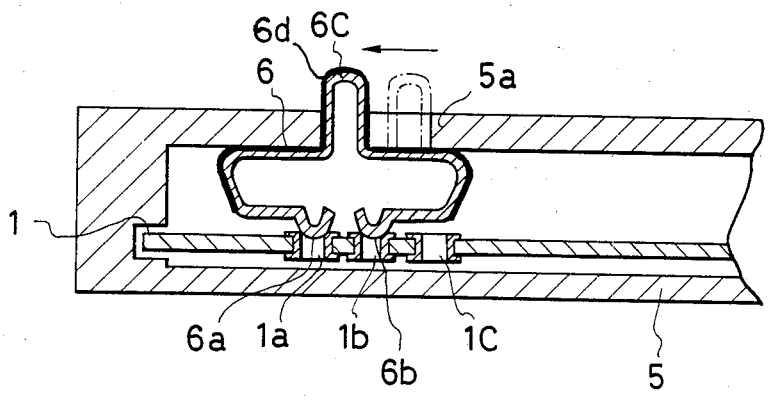
FIG. 4 is a cross-sectional view showing a second embodiment of the slidable switch for a card module according to the present invention.

FIG. 4 shows a second embodiment of the switch for a card module according to the present invention, in which the movable contact member 6 is directly housed within the card module housing 5 without use of the insulaton member 7. A knob portion 6*c* thereof is formed integral with the movable contact member 6 in such a way as to project through an opening 5*a* formed in the card module housing 5. That is the movable contact 6 is formed into a reverse T-shaped hollow member in cross-section having a vertical knob portion 6*c* which is substantially the shape of a inverted "U" and a horizontal cross bar portion having a split in the middle thereof so as to provide two free ends each of which are deformed so as to define two convex contact portions.

In this second embodiment, it is of course preferable to coat the outer surface of the contact member 6 with an insulating material 6*d* except the convex contact portions 6*a* and 6*b* connectable to the fixed through hole contacts 1*a*, 1*b* and 1*c*.

To coat the movable contact 6 with an insulating material, an insulation paint 6*d* is applied onto the surface of the movable contact 6, or a conductive material whose one surface has already been insulated is formed into the shape as shown in FIG. 4.

The above embodiments have been explained of the slidable switch for a card module provided with three fixed through hole contacts and two movable convex contacts, by way of example. However, without being limited to the above, the numbers of these two movable and fixed contact members can be determined freely according to the required changing-over switch functions.

As described above, in the slidable switch for a card module according to the present invention, since the movable contact member is formed with the convex contact portions slidably engageable with the fixed through hole contacts formed in the PCB, it is possible to obtain a stable click feeling of the change-over switch in spite of a simple switch structure.

What is claimed is:

1. A slidable switch for a card module provided on a printed circuit board housed within a card module housing having an opening defined through a wall thereof, which comprises:

(a) a plurality of fixed recessed contacts arranged in the board;

(b) a movable, electrically conductive contact formed with a least two convex contact portions selectively contactable to at least one of said fixed recessed contacts when moved to and fro within the card module housing, said movable conductive contact also having a knob portion integral with said contact portions, said knob portion having a size and shape so as to extend outwardly through the opening in the card module housing; and (c) insulating material coating at least said knob portion of said movable contact, whereby movement of said knob portion within said opening controls positioning of said two convex contact portions relative to said recessed contacts.

2. The slidable switch for a card module as set forth in claim 1, wherein said fixed recessed contacts comprise through hole contacts.

3. The slidable switch for a card module for as set forth in claim 1, wherein said movable contact is formed into an inverted T-shaped hollow member in cross-section, having a stem and a horizontal cross bar portion, said stem of said inverted T-shaped hollow member being substantially inverted U shaped in cross-section so as to define said knob portion, said horizontal cross bar portion of said inverted T-shaped hollow member having a cut out portion along the length thereof so as to define two free ends, each of said free ends being deformed so as to form said two convex contact portions.

* * * * *